US006762556B2

(12) United States Patent
Winsor

(10) Patent No.: US 6,762,556 B2
(45) Date of Patent: Jul. 13, 2004

(54) OPEN CHAMBER PHOTOLUMINESCENT LAMP

(75) Inventor: Mark Winsor, Chehalis, WA (US)

(73) Assignee: Winsor Corporation, Chehalis, WA (US)

( * ) Notice: Subject to any disclaimer, the term of this patent is extended or adjusted under 35 U.S.C. 154(b) by 467 days.

(21) Appl. No.: 09/796,334

(22) Filed: Feb. 27, 2001

(65) Prior Publication Data

US 2002/0117959 A1 Aug. 29, 2002

(51) Int. Cl.[7] ..... H01J 1/62

(52) U.S. Cl. ..... 313/607; 313/594; 313/234; 313/493; 313/634

(58) Field of Search ..... 313/607, 594, 313/234, 493, 581, 634

(56) References Cited

U.S. PATENT DOCUMENTS

| | | | | |
|---|---|---|---|---|
| 1,984,215 | A | 12/1934 | Hotchner | 176/14 |
| 2,102,049 | A | 12/1937 | Warren | 176/122 |
| 2,255,431 | A | 9/1941 | Marden et al. | 176/122 |
| 2,405,518 | A | 8/1946 | Polevitzky | 176/122 |
| 2,555,749 | A | 6/1951 | Krefft | 313/109 |
| 2,733,368 | A | 1/1956 | Kolkman | 313/109 |
| 2,774,918 | A | 12/1956 | Lemmers | 315/98 |
| 2,900,545 | A | 8/1959 | Rulon et al. | 313/108 |
| 2,906,631 | A | 9/1959 | Rindone | 106/48 |
| 3,047,763 | A | 7/1962 | Inman | 313/109 |
| 3,112,426 | A | 11/1963 | Carter et al. | 315/39 |
| 3,121,184 | A | 2/1964 | Fox | 313/207 |
| 3,198,943 | A | 8/1965 | Pistey | 240/51.11 |
| 3,226,590 | A | 12/1965 | Christy | 313/109 |
| 3,253,176 | A | 5/1966 | Pate et al. | 313/204 |
| 3,258,630 | A | 6/1966 | Scott | 313/109 |
| 3,508,103 | A | 4/1970 | Young | 313/109 |

(List continued on next page.)

FOREIGN PATENT DOCUMENTS

| | | |
|---|---|---|
| DE | 39 22 865 A1 | 1/1991 |
| EP | 0 066 495 | 12/1982 |
| GB | 363343 | 12/1931 |

(List continued on next page.)

OTHER PUBLICATIONS

Volkova, G. et al., "Vacuum–Ultraviolet Lamps With a Barrier Discharge In Inert Gases," Zhurnal Prikladnoi Spaktroskopii (trans.), 41(4):691–695, 1984.

Mercer et al., "Fluorescent backlights for LCDs," *Information Display*: 8–13, 1989.

Sanyo Electric Co., Ltd., "Flat Fluorescent Lamp Specifications".

(List continued on next page.)

*Primary Examiner*—Ashok Patel
(74) *Attorney, Agent, or Firm*—Seed IP Law Group PLLC

(57) ABSTRACT

An apparatus and method are disclosed for an open chamber photoluminescent lamp. The photoluminescent planar lamp is gas-filled and contains photoluminescent materials that emit visible light when the gas emits ultraviolet energy in response to a plasma discharge. The lamp comprises first and second opposing plates manufactured from a glass material having a loss tangent $\leqq 0.05\%$. In another embodiment the first and second plates have a dielectric constant greater than 5. In yet another embodiment, the first and second plates have a volume resistivity greater than $1\times10^{12}$ Ωcm. A plurality of sidewalls are coupled to peripheral edges of the first and second plates so that the sidewalls and opposing surfaces of the first and second plates define an interior portion that contains the gas and photoluminescent material, and first and second spaced-apart electrodes disposed along an exterior surface of at least one of the first and second plates to create an electric field when electrical power is applied thereto whereby the electric field interacts with the gas contained by the interior chamber.

21 Claims, 7 Drawing Sheets

U.S. PATENT DOCUMENTS

| | | | | |
|---|---|---|---|---|
| 3,646,383 | A | 2/1972 | Jones et al. | 313/109 |
| 3,649,864 | A | 3/1972 | Willemsen | 313/221 |
| 3,967,153 | A | 6/1976 | Milke et al. | 313/489 |
| 4,079,288 | A | 3/1978 | Maloney et al. | 313/489 |
| 4,117,374 | A | 9/1978 | Witting | 315/99 |
| 4,234,817 | A | 11/1980 | Teshima et al. | 313/493 |
| 4,245,179 | A | 1/1981 | Buhrer | 315/248 |
| 4,266,167 | A | 5/1981 | Proud et al. | 315/248 |
| 4,312,028 | A | 1/1982 | Hamacher | 362/369 |
| 4,363,998 | A | 12/1982 | Graff et al. | 313/487 |
| 4,549,110 | A | 10/1985 | Berman et al. | 313/485 |
| 4,698,547 | A | 10/1987 | Grossman et al. | 313/485 |
| 4,710,679 | A | 12/1987 | Budinger et al. | 315/58 |
| 4,743,799 | A | 5/1988 | Loy | 313/493 |
| 4,767,965 | A | 8/1988 | Yamano et al. | 313/491 |
| 4,772,819 | A | 9/1988 | Ridders | 313/493 |
| 4,803,399 | A | 2/1989 | Ogawa et al. | 313/493 |
| 4,837,519 | A | 6/1989 | Lopetrone et al. | 324/529 |
| 4,839,555 | A | 6/1989 | O'Mahoney | 313/493 |
| 4,851,734 | A | 7/1989 | Hamai et al. | 313/485 |
| 4,899,080 | A | 2/1990 | Vriens et al. | 313/477 |
| 4,916,352 | A | 4/1990 | Haim et al. | 313/25 |
| 4,916,356 | A | 4/1990 | Ahern et al. | 313/336 |
| 4,916,359 | A | 4/1990 | Jonsson | 313/489 |
| 4,920,298 | A | 4/1990 | Hinotani et al. | 313/493 |
| 4,924,143 | A | 5/1990 | Imamura et al. | 313/493 |
| 5,006,758 | A | 4/1991 | Gellert et al. | 313/634 |
| 5,066,257 | A | 11/1991 | Farner et al. | 445/26 |
| 5,117,160 | A | 5/1992 | Konda et al. | 315/326 |
| 5,190,365 | A | 3/1993 | Cordy, Jr. | 362/26 |
| 5,220,249 | A | 6/1993 | Tsukada | 315/246 |
| 5,267,062 | A | 11/1993 | Bottorf | 359/40 |
| 5,276,378 | A | 1/1994 | Gothard | 313/491 |
| 5,319,282 | A | 6/1994 | Winsor | 315/169.4 |
| 5,343,114 | A | 8/1994 | Beneking et al. | 313/485 |
| 5,343,116 | A | 8/1994 | Winsor | 313/493 |
| 5,420,481 | A | 5/1995 | McCanney | 315/291 |
| 5,463,274 | A | 10/1995 | Winsor | 313/493 |
| 5,466,990 | A | 11/1995 | Winsor | 315/56 |
| 5,479,069 | A | 12/1995 | Winsor | 313/493 |
| 5,479,071 | A | 12/1995 | Lynn | 313/514 |
| 5,609,410 | A | 3/1997 | Rives | 362/226 |
| 5,616,989 | A | 4/1997 | Taillie et al. | 315/32 |
| 5,818,164 | A | 10/1998 | Winsor | 313/493 |
| 5,841,230 | A | 11/1998 | Ikoma et al. | 313/506 |
| 5,850,122 | A | 12/1998 | Winsor | 313/493 |
| 5,903,096 | A | 5/1999 | Winsor | 313/493 |
| 5,994,849 | A | 11/1999 | Vollkommer et al. | 315/246 |
| 6,369,523 | B2 * | 4/2002 | Matsuura et al. | 315/291 |
| 6,525,451 | B1 * | 2/2003 | Hishinuma et al. | 313/234 |
| 6,570,301 | B1 * | 5/2003 | Hishinuma et al. | 313/36 |

FOREIGN PATENT DOCUMENTS

| | | |
|---|---|---|
| GB | 436894 | 10/1935 |
| GB | 947340 | 1/1964 |
| GB | 2 034 681 | 5/1980 |
| GB | 2 247 977 A | 3/1992 |
| JP | 63-136452 | 6/1988 |
| JP | 1-206553 | 8/1989 |
| JP | 2-72552 | 3/1990 |
| JP | 2-78147 | 3/1990 |
| JP | 2-244552 | 9/1990 |
| JP | 3-46748 | 2/1991 |
| JP | 3-129659 | 6/1991 |
| JP | 3-222253 | 10/1991 |
| JP | 3-225743 | 10/1991 |
| JP | 3-246865 | 11/1991 |
| JP | 3-285249 | 12/1991 |
| JP | 4-95337 | 3/1992 |
| JP | 4-147554 | 5/1992 |
| JP | 6-251876 | 9/1994 |
| JP | 11-086797 | 3/1999 |
| JP | 11-312498 | 11/1999 |
| WO | 92/02947 | 2/1992 |
| WO | 92/05571 | 4/1992 |
| WO | 93/13514 | 7/1993 |
| WO | 94/14179 | 6/1994 |
| WO | WO 99/34411 | 7/1999 |
| WO | WO 99/48134 | 9/1999 |
| WO | WO 00/58998 | 10/2000 |

OTHER PUBLICATIONS

Hinotani et al., "Flat Fluorescent Lamp for LCD Back–Light," *1998 International Display Research Conference*.

Llemer, M. et al., "Invited Paper: Hg–free Flat Panel Light Source PLANON—a Promising Candidate for Future LCD Backlights," *SID Digest*:931–933, 2000.

Noguchi, H. et al., "A Mercury–Free Cold cathode Fluorescent Lamp for LCD Backlighting," *SID Digest*:935–937, 2000.

Ikeda, Y. et al., "Mercury–Free, Simple–Structured Flat Discharge LCD Backlights Ranging from 0.5 to 5.2–in. Diagonals," *SID Digest*:938–941, 2000.

Murdoch, J.B., *Illuminating Engineering*, Macmillan Pub. Co., New York, 1985, Chapter 6, "Lamps," pp. 191–237.

Choi, et al., "Mercury–Free 18" Class Flat Fluorescent Lamp with Good Uniformity, *Proceedings of the Conference of International Display Manufacturing*, 2000, 231–232.

Mikoshiba, S., "19.1: Invited Paper: Xe Discharge Backlights for LCDs," *Proceedings of the Conference of Society for Information Display*, 2001, pp 286–289.

Y Baba et al., "19.2: A 100,000–cd/m$^2$, Capacity Coupled Electrodeless Discharge Backlight with High Efficacy for LC TVs," *Proceedings of the Conference of Society for Information Display*, 2001, pp 290–293.

Urakabe et al., "A Flat Flourescent Lamp With Xe Dieclectric Barrier Discharges," *The Illuminating Engineering Institute of Japan*, Jun. 17, 1996, 6 pp.

Munke, H. et al., "Werstoffkunde für die Elektrotechnik und Elektronik," *Veb Verlag Technik*, Berlin, pp. 307–310, 1983, XP002213968.

* cited by examiner

OPEN CHAMBER PHOTOLUMINESCENT LAMP

TECHNICAL FIELD

This invention relates to planar photoluminescent lamps, and more particularly, to a planar photoluminescent lamp having two electrodes and which emits light by fluorescent phenomena.

BACKGROUND OF THE INVENTION

Thin, planar, and relatively large area light sources are needed in many applications. Backlights must often be provided for liquid crystal displays (LCD) to make them readable in all environments. Because present active matrix LCDs allow only up to approximately 5% light transmission, the backlights must produce enough light to permit readability in low light conditions. Thin backlights for LCDs are desired to preserve as much as possible the LCDs' traditional strengths of thin profile, low cost, and readability in high ambient lighting conditions while permitting readability at numerous angles.

Many demanding challenges exist for engineering a thin planar source of uniform light. If incandescent lamps or LEDs are used as the light source, then optics for dispersing and diffusing light from the multiple point sources to the planar viewing surface must be provided to avoid local bright or dim spots. Despite recent advances, LEDs are spectrally limited, which reduces their applicability for situations where white light is desired. Additionally, provision must be made to dissipate the heat generated by the incandescent or LEDs or alternatively, to utilize only high-temperature materials for LCDs. Electroluminescent lamps suffer from having a relatively low brightness but are sometimes selected as solutions that require only low light display outputs.

Another choice for generating light for a display is photoluminescent technology, including fluorescent lamps. Fluorescent lamps have the advantage of being relatively efficient and capable of generating sufficiently bright light. Tubular fluorescent lamps of about 2 mm in diameter are often used as a backlight, but have the undesirable property of uneven light distribution. Planar fluorescent lamps are well known in the art, having been described, for example, in U.S. Pat. Nos. 3,508,103; 3,646,383; and 3,047,763. Typically, such lamps in the prior art are formed by molding a housing and a cover, each from a piece of glass and sealing the glass pieces to form a sealed enclosure. A selected gas and a fluorescent material are placed in the sealed enclosure for emitting light when an electrical field is applied. Typical fluorescent lamps often have bare metal electrodes, which are exposed to ionized particles of the gas thereby causing undesirable sputtering effects.

Where the enclosure is formed entirely from glass, fabrication can be difficult and the resulting lamp is often quite fragile. A stronger lamp can be made by using thicker pieces of glass to form a lamp having thicker walls. However, increased glass thickness results in a undesirably thicker and heavier lamp, is more difficult to fabricate and may attenuate some light output.

Planar fluorescent lamps having sidewalls formed from metal with a serpentine channel defined by internal walls are known from U.S. Pat. Nos. 2,508,103 and 2,405,518. The sidewalls and internal walls of the serpentine channel provides support for the top and bottom covers. However, longer serpentine channels require undesirably higher electrode voltages that are necessary to ionize the selected gases. Large display areas using planar fluorescent lamps having such internal walls require that many planar fluorescent lamps be tiled together to provide large areas of illumination.

A need remains therefor, for a thin, lightweight, planar lamp having a substantially uniform display that is easily manufacturable, is readily scaleable to larger display sizes, is temperature tolerant, and is relatively durable.

SUMMARY OF THE INVENTION

The limitations of prior lamps are overcome by the present invention, which is an open chamber photoluminescent lamp and a method of producing an open chamber photoluminescent lamp. In a sample embodiment, a gas-filled photoluminescent planar lamp contains a photoluminescent material that emits visible light in response to ultraviolet energy emitted from an ionized gas. The lamp contains first and second opposing glass plates that are made from glass material having a loss tangent of less than around 0.05%. A plurality of sidewalls are coupled to the peripheral edges of the first and second plates so that a chamber is formed that contains the gas and photoluminescent material. The lamp also contains first and second electrodes disposed along an exterior surface of at least one of the first and second plates so that an electrical field is created when electrical power is applied to the electrodes so that the electric field interacts with the gas contained within the chamber.

In another embodiment, the lamp may further contain a plurality of spacers that are distributed between the first and second glass plates at predetermined locations so that the first and second plates will be maintained at a predetermined distance from each other. The spacers may be further manufactured from glass material that is transmissive to ultraviolet radiation. The lamp may further contain a plurality of spacers positioned between the first and second plates so that the first and second plates will be maintained at a distance of less than around 0.5 mm from each other.

In yet another embodiment, the lamp contains sidewalls that are sized to maintain the first and second plates at a distance of less than around 0.5 mm between the first and second plates.

In yet another embodiment the first plate is less than around 1 mm thick. The lamp may be further constituted such that the distance from the exterior surface of the first plate to the exterior surface of the second plate is less than around 5.0 mm.

In yet another embodiment, the electrodes are disposed along the exterior surface of only one of the first and second plates. Alternatively, the first electrode may be disposed along the exterior surface of the first plate and the second electrode may be disposed along the exterior surface of the second plate.

In further embodiments, the lamp comprises a first plate having a dielectric constant of greater than around 5, the lamp comprises at least one plate being manufactured from planar glass material that is substantially free of sodium, and the lamp further comprises a layer of photoluminescent material applied to an inner surface of at least one of the first and second plates to luminesce in response to ionization of the contained gas.

In another example embodiment, a gas-filled photoluminescent planar lamp contains a photoluminescent material that emits visible light when the gas emits ultraviolet energy in response to a plasma discharge. The lamp contains first and second opposing glass plates that are made from glass material having a dielectric constant greater than 5.0. A plurality of sidewalls are coupled to the peripheral edges of the first and second plates so that a chamber is formed that contains the gas and photoluminescent material. The lamp also contains first and second electrodes disposed along an exterior surface of at least one of the first and second plates so that an electrical field is created when electrical power is applied to the electrodes so that the electric field interacts with the gas contained within the chamber.

DETAILED DESCRIPTION OF THE INVENTION

Figure 1:
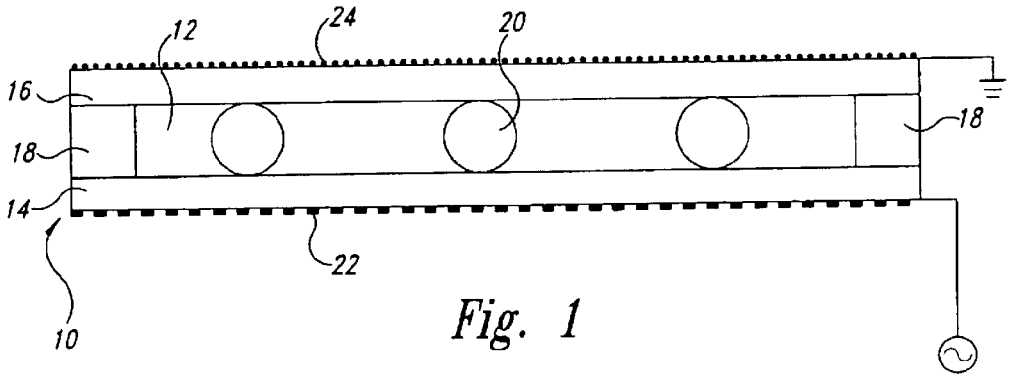
FIG. 1 is a schematic of the invention in cross-section.

FIG. 1 illustrates a lamp 10 having a single open chamber 12. The chamber 12 is an interior portion of the lamp 10 formed by the sealed enclosure of a pair of opposing planar plates, namely a bottom plate 14 and a top plate 16, and sidewalls 18 being coupled to the peripheral edges of the bottom and top plates. The chamber 12 contains an ultraviolet-emissive gas (not shown) such as Mercury vapor in a noble gas environment, which environment in one embodiment may comprise Xenon, Argon, and the like. Although mercury vapor is frequently used in fluorescent lamps, it is well known to use other gases, such as Argon, Xenon, a mixture of inert and halogen gases and the like, either alone or in combination to produce the desired spectral characteristics. In addition, it is known to vary the lamp pressure to alter the spectral characteristics of the lamp for a given gas. Furthermore, it is known to use photoluminescent materials other than phosphors to generate visible light energy in response to excitation by UV radiation. Accordingly, the present invention is not limited by the lamp pressure, the type of photoluminescent material, or type of gas used to fill the lamp 10.

Ultraviolet-transmissive spacers 20 are spaced apart and distributed between the plates 14 and 16 to support the plates and thereby minimize the danger of implosion due to net positive external atmospheric pressures. For the purpose of clarity, not all spacers 20 are shown, nor are they drawn to scale, in FIGS. 1–9.

A bottom planar electrode 22 and a top planar electrode 24 in one embodiment are on the exterior surfaces of the plates 14 and 16, respectively. The electrodes 22 and 24 are coupled to opposite sides of an alternating current (AC) power supply. Alternatively, the bottom electrode 22 is coupled to the AC power supply and the top electrode 24 is coupled to ground. The electrodes 22 and 24 are used to create an electric field by capacitive coupling through the dielectric of the plates 14 and 16, which in turn produces a stable and uniform plasma from the ultraviolet-emissive gas in the chamber 12. The plasma acts as a uniform source of ultraviolet light, which is a condition conducive to uniform visible light generation.

Figure 2:
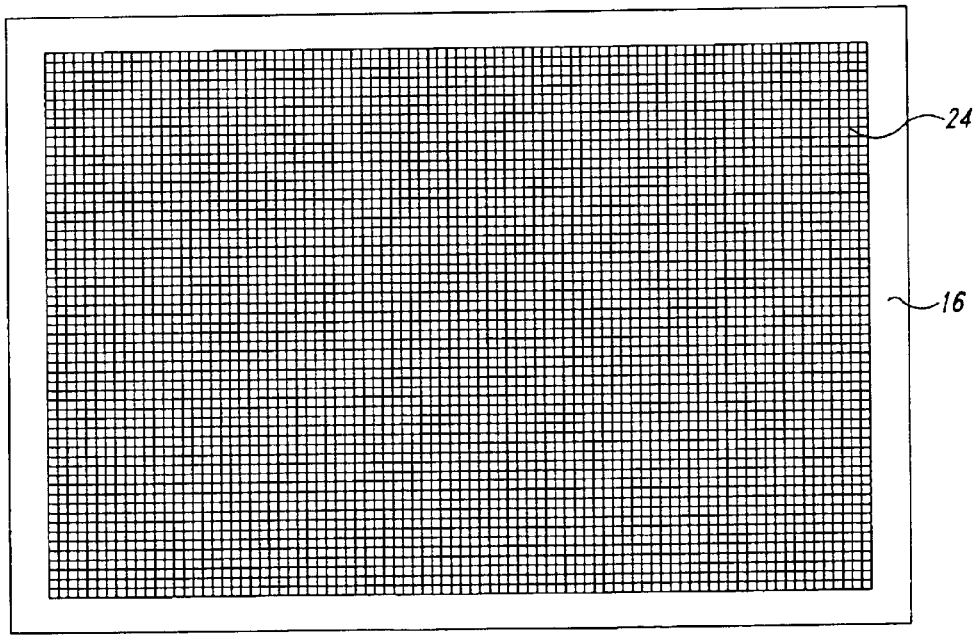
FIG. 2 is a top plan view of an example of the patterning of a top electrode.

At least one of the electrodes is designed to permit light to exit from the chamber 12. Usually the top electrode 24 is transparent or finely drawn as to permit light to pass by without causing undesirable gradations in the produced illumination. FIG. 2 illustrates one embodiment where the top electrode 24 comprises conductive lines patterned as a grid on the exterior surface of the plate 16 using a laser or ultraviolet (UV) light and an aqueous development process to yield highly conductive lines of a silver-based compound (such as Fodel® as produced by DuPont®) drawn to widths of about 5–150$\mu$, with a spacing of about 40–1000$\mu$. For the purpose of clarity, not all lines of the top electrode 24 are shown in FIG. 2.

Figure 3:
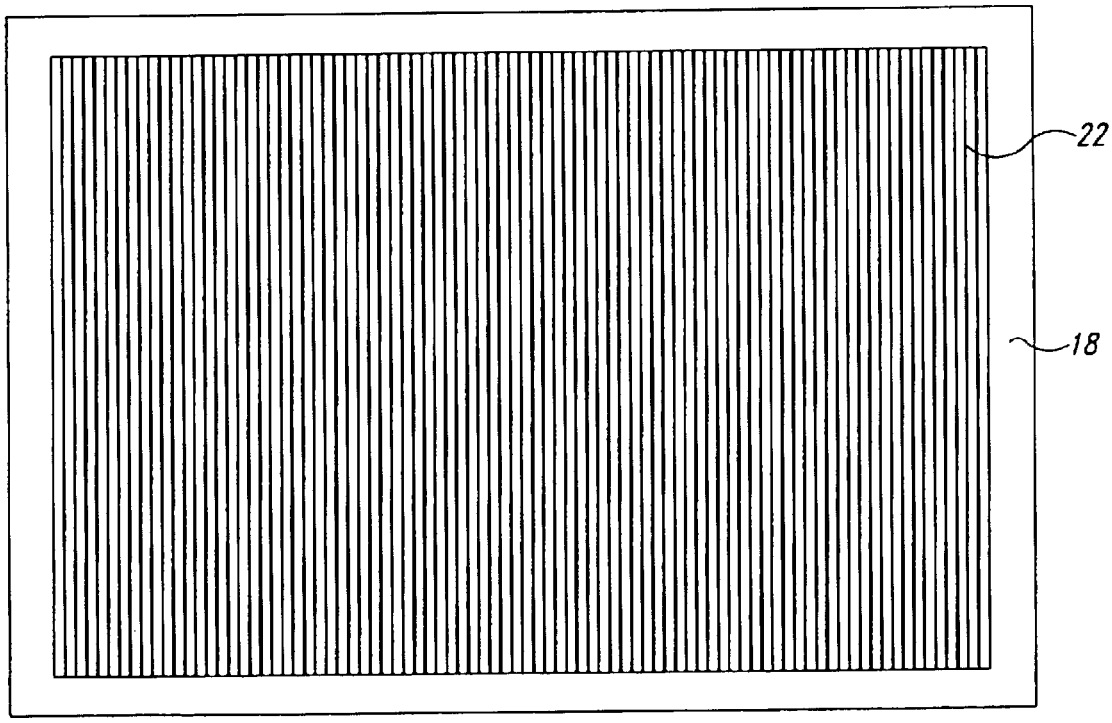
FIG. 3 is a bottom plan view of an example of the patterning of a bottom electrode.

The bottom electrode 22 may be deposited on the exterior surface of the bottom plate 14 using a conventional, and more economical, screen printing process. FIG. 3 illustrates one embodiment where the bottom electrode 22 is deposited as a series of parallel lines that are wider than the top electrode 24. The width of the lines of the bottom electrode 22 may be wider than the line of the top electrode 24 because the bottom surface of chamber 12 reflects, and does not pass, the light produced by the lamp. In an example embodiment, a reflective coating such as $TiO_2$ or $Al_2O_3$ may be deposited on the exterior surface of the bottom plate 14 so that more light is reflected towards the top surface. Thus, the width of the lines of the bottom electrode 22 does not cause undesirable gradations in the produced illumination. For the sake of clarity, not all lines of bottom electrode 22 are shown in FIG. 3.

In another example embodiment, the electrodes 22 and 24 may be disposed so that one of the electrodes 22 and 24 is on an exterior surface and a second electrode is on an interior surface. In yet another embodiment both electrodes 22 and 24 may be disposed on the same surface in a coplanar arrangement, as illustrated in FIGS. 6 to 9.

It will be understood by those skilled in the art that the number and shape of lines of the electrodes 22 and 24 and the spacers 20 may be varied greatly without departing from the scope of the invention. It will also be apparent to those skilled in the art that the electrodes may be also placed on the interior surfaces of the plates 14 and 16, or even on the exterior surface of one plate and the interior surface of its opposing plate. In the exemplary embodiment, the electrodes 22 and 24 are disposed on the exterior surfaces of the plates 14 and 16, so as to maximize the distance between the electrodes, and minimize near-field effects, which effects result in undesirable non-uniform illumination across the face of the lamp 10. In another variation of the embodiment, the electrodes 22 and 24 may also be interdigitated so that substantial lengths of conductors of the top electrode 24 do not directly overlie substantial lengths of conductors of the bottom electrode 22.

According to one aspect of the invention, the bottom plate 14 and the top plate 16 are made from an alkaline earth aluminosilicate glass having suitable characteristics such as a high operating temperature, high transmissivity of light at the desired output wavelength, low coefficient of thermal expansion, low thermal shrinkage, high dielectric strength, and high volume resistivity. For example, Corning® type 1737F glass has been found to be suitable and provides a coefficient of thermal expansion of $37.6\times10^{-7}/°$ C. through a temperature range of 0°–300° C., a dielectric constant of less than about 6 (and greater than 5 at frequencies above 100 Hz) through a temperature range of 0–300° C., a dielectric strength of over 1000 V/mil, and a loss tangent of less than about 0.05% for frequencies above 100 Hz through a temperature range of 0–300° C. The glass is also substantially free of mobile sodium and potassium ions, which can cause solarization under exposure to ultraviolet light.

As is known in the art, glass is often used as a dielectric element in a capacitor. The parallel plates 14 and 16 of the lamp 10 along with the electrodes 22 and 24 essentially form a capacitor where the glass of the plates function as a dielectric. Unfortunately, glass is also a conductor that decreases in resistivity as the temperature increases. When glass having a low volume resistivity is used, the current flowing through the glass generates heat, which further reduces the resistance of the glass. The lowering of the resistance of glass cause more current to flow, which unfavorably causes the temperature of the glass to increase even more and may ultimately lead to failure of the device. This undesirable positive feedback may be overcome by using glass having a volume resistivity sufficiently high enough to prevent the glass from warming appreciably. In a typical embodiment of the present invention, glass having a volume resistivity of over $1\times10^{12}$ Ωcm at room temperature has been found to be suitable.

Because the lamp 10 operates as a capacitor, it is desirable to use materials with a high dielectric constant so as to increase the effective capacitance and thus increase current flow through the lamp. However, glass having high dielectric constants also tend to have low volume resistivity, which has the undesirable characteristics described above. Glass used in the plates 14 and 16 is selected to have a reasonably high dielectric constant (e.g., greater than 5) while also maintaining a high volume resistivity (e.g., greater than $1\times10^{12}$ Ωcm). Accordingly, the selected glass will have a loss tangent of less than 0.05%. As is known in the art, the loss tangent of a material is the ratio of the imaginary part to the real part of the relative permeability of the material. Another way to increase the effective capacitance for a given glass material is to decrease the spacing between the plates 14 and 16. As will be described in greater detail below, the lamp 10 is constructed to reduce the separation between the plates 14 and 16.

Figure 4:
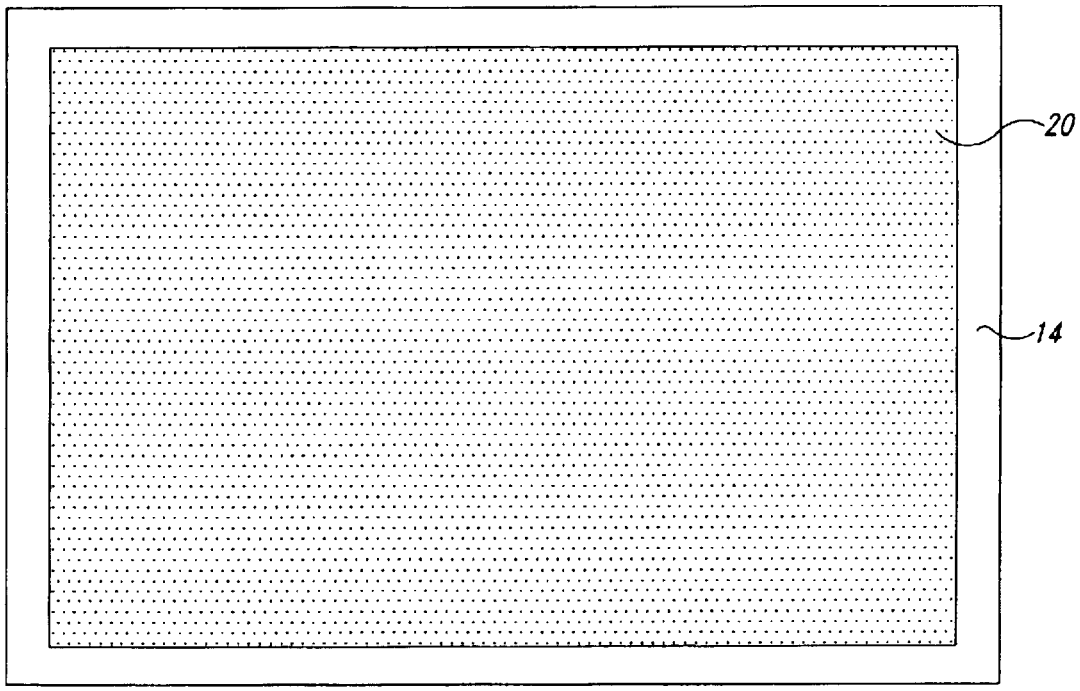
FIG. 4 is a top plan view of an example of the patterning of spacers.

The integrity of the sealed chamber 12 provided by the bottom plate 14 and the top plate 16 is partially a function of the thickness of the plates, the arrangement and number of the spacers 20 provided between the plates, and net atmospheric pressures. The net atmospheric pressure is the difference between external atmospheric pressure and the pressure of the gasses within the chamber 12. The glass of the plates 14 and 16 must be strong and thick enough to withstand external atmospheric pressure exerted against spans of the plates that are not supported directly by the spacers 20 to prevent implosion of the lamp 10. In one embodiment, the thickness of the bottom plate 14 and the top plate 16 is approximately 1 mm or less for each plate, and the spacers 20 are arranged on 0.25 in. (6.35 mm) centers. The spacers 20 are typically highly UV-transmissive glass beads, and have a diameter selected to match the height of the sidewall 18, as shown in FIG. 1. The UV-transmissive characteristic of the spacers 20 allows UV light generated in the chamber 12 to pass through the spacers unimpeded and thus reduce undesirable dim spots in the lamp 10. The spacers 20 are distributed uniformly across the chamber 12 so as to provide support "columns" for the faces of the plates 14 and 16 at a height equal to the sidewall 18. In the exemplary embodiment, the spacers 20 are approximately 0.020 in. (0.51 mm) in diameter and are resistant to solarization. FIG. 4 illustrates the placement of the spacers 20 that may conveniently be affixed to the bottom plate 14 during assembly of the lamp. Assembly details are provided below.

The sidewall 18 is also 0.020 in. (0.51 mm) in height and 0.040–0.100 in. (1–2.5 mm) in width. The sidewall 18 is comprised of a material suitable for use as a devitrifying frit (or solder glass) and has a coefficient of thermal expansion selected to match the coefficient of thermal expansion of the glass used for the plates 14 and 16.

Figure 5:
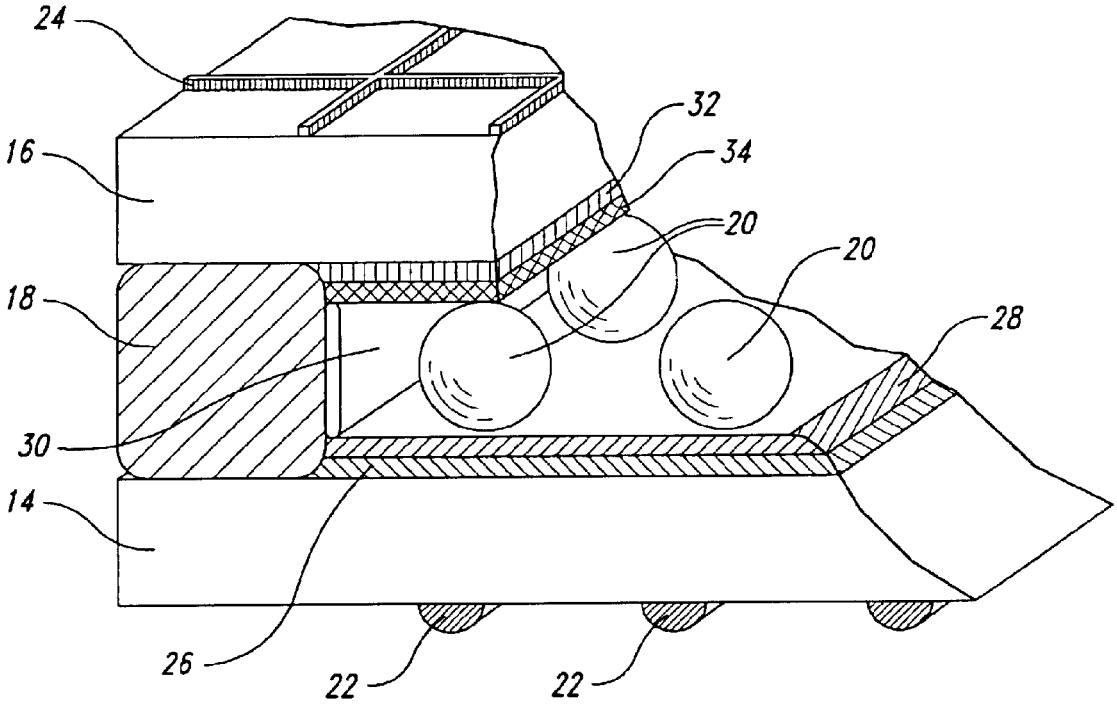
FIG. 5 is a fragmentary cut-away cross-sectional view of a planar lamp according to one embodiment of the invention.

FIG. 5 is a fragmentary cut-away view of the lamp 10 according to one embodiment illustrating the constituents of the chamber 12, the plates 14 and 16, and the electrodes 22 and 24. A 60$\mu$-thick reflective layer 26 of $Al_2O_3$ or $BaTiO_3$ is deposited on the interior surface of the bottom plate 14 that is subjacent to chamber 12. Reflective layer 26 is used at the bottom of the lamp to reflect light that is directed downwards from the chamber 12 so that the reflected light is emitted through the top of the lamp. A 60$\mu$-thick bottom phosphor layer 28 of rare earth phosphors and $Al_2O_3$ is deposited on the reflective layer 26. The rare earth phosphors are selected to emit red, green, and blue light in the presence of ultraviolet radiation produced from the plasma of the ultraviolet-emissive gas (not shown) contained by the chamber 12. Suitable rare earth phosphors that fluoresce in response to ultraviolet radiation are well known in the art. One skilled in the art will also appreciate that electroluminescent materials (which emit light when subjected to an alternating electric field) such as ZnS may be effectively used as well.

An electron emissive coating (not shown) comprising a thin film (around 0.5$\mu$) of MgO may be optionally applied to the interior surface of the bottom plate 14 before the reflective layer 26 is applied. One skilled in the art will appreciate that MgO has a high coefficient of secondary electron emission, which increases the efficiency and ionization of the contained gas in producing ultraviolet light. The coefficient of secondary electron emission is the ratio of secondary electrons (electrons that are ejected from a metallic surface as a result of incident electrons colliding with the metallic surface) to incident electrons, which here are produced by ionizing the gas. As is known in the art, a thin film of MgO also functions as a passivation layer, which here protects the glass from erosion and solarization of the glass by the incident electrons, ions, and UV energy.

The spacers 20 are affixed to the bottom phosphor layer 28 with an organic binder (not shown) on 0.25 in. centers, in a pattern such as exemplified in FIG. 4. As discussed above, it will be readily apparent to those skilled in the art that other suitable arrangements of spacers 20 may be made.

Referring again to FIG. 5, an electron emissive coating 32 comprising a thin-film (around 0.5$\mu$) of MgO is applied to the interior surface of the top plate 16 that defines the top of the chamber 12. One skilled in the art will appreciate that the emissive coating may be omitted, although the omission will result in less satisfactory results. A top phosphor layer 34 is a 15$\mu$-thick layer of rare earth phosphors and $Al_2O_3$ that is applied to the exposed surface of the passivation layer 32. An optional side phosphor layer 30 of rare earth phosphors similar in thickness and composition to the top or bottom phosphor layers 26–28 may be applied to a portion of the interior surface of the sidewall 18 that intervenes between the bottom phosphor layer 28 and the top phosphor layer 34 to increase the brightness of lamp 10. The components of the lamp 10 are assembled within a vacuum furnace (not shown). The vacuum furnace is used in a conjoined process step to evacuate atmospheric gasses from the chamber 12, fill the chamber 12 with an ultra-violet emissive gas, and seal the chamber 12.

Figure 6:
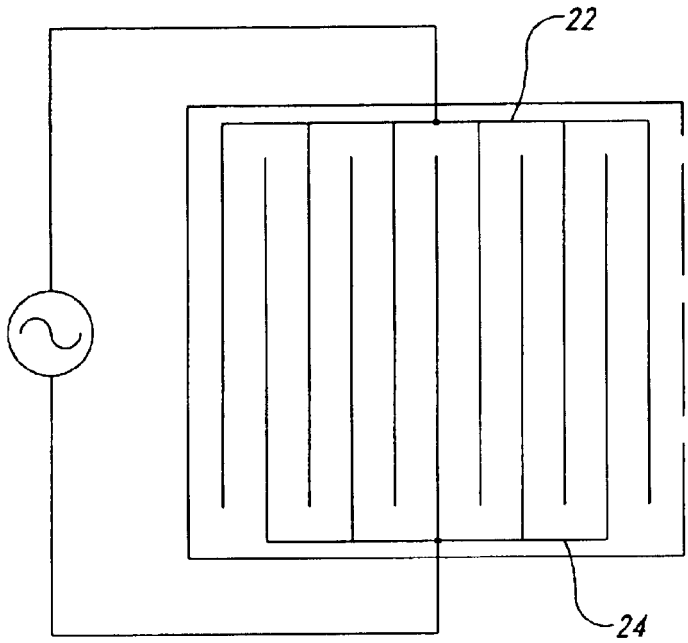
FIGS. 6–9 are top plan views, of alternative electrode patterns used in planar lamps.
Figure 7:
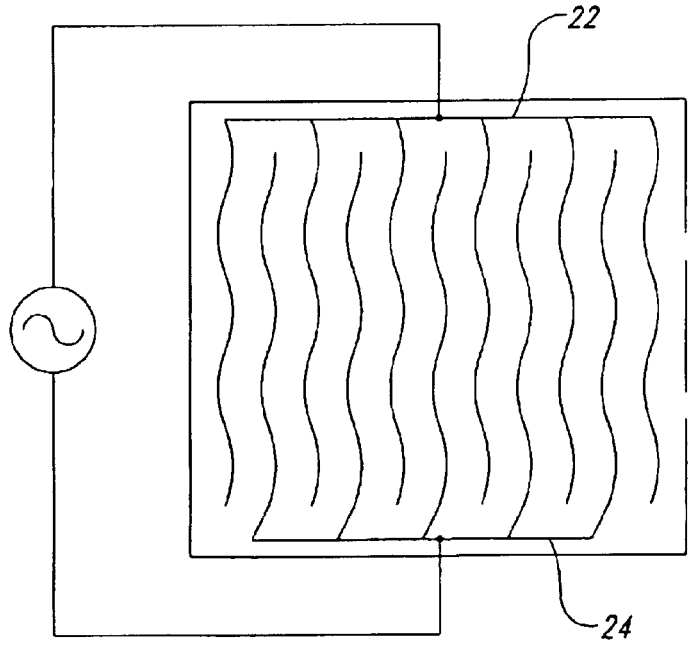
Figure 8:
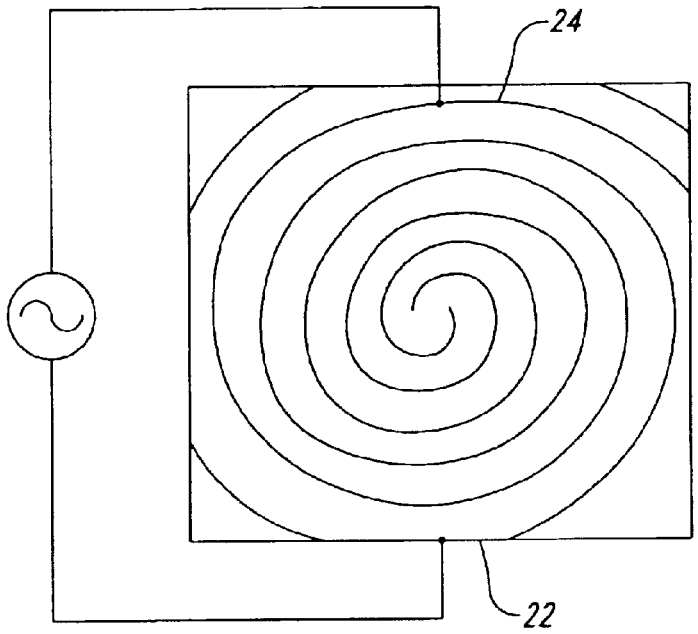
Figure 9:
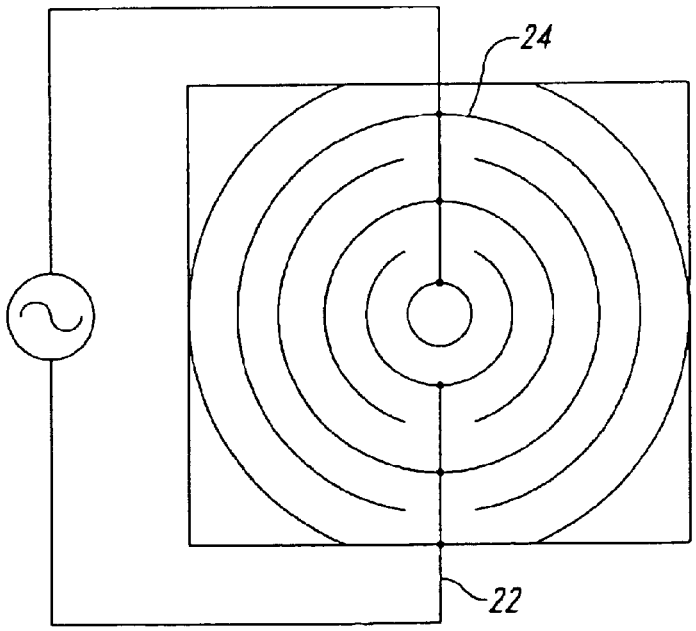
Figure 10:
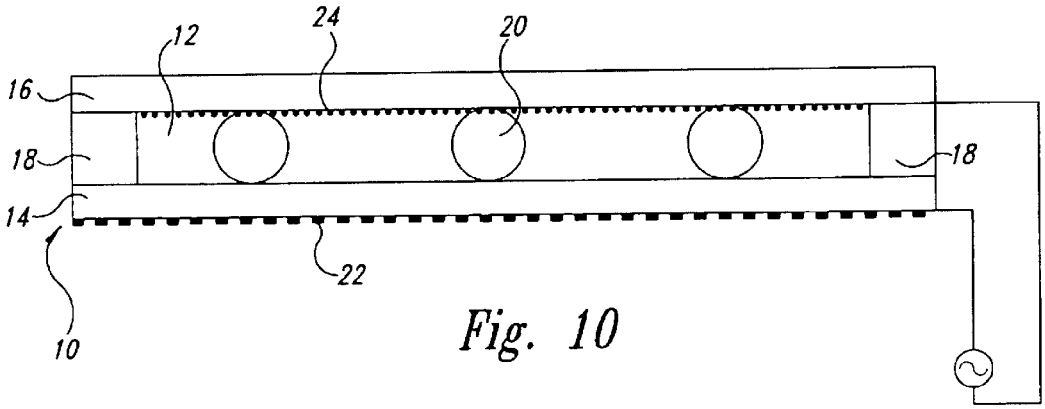
FIGS. 10 and 11 are schematics of alternate embodiments of the invention.
Figure 11:
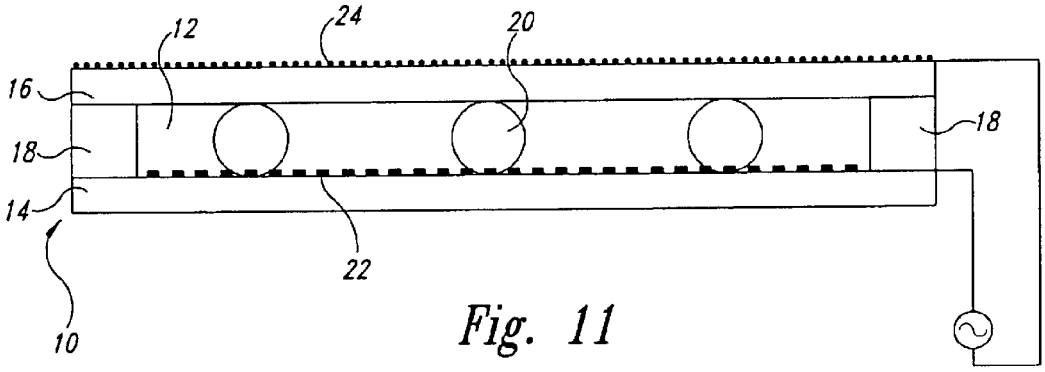

As noted above, the specific pattern of the electrodes 22 and 24 can be varied without detrimental effect on the quality and uniformity of light produced by the lamp 10. For example, FIGS. 6–9 illustrate some selected alternatives for the arrangement of the electrodes 22 and 24 for the lamp 10. FIG. 6 illustrates the arrangement of the electrodes 22 and 24 wherein the electrodes are arranged as a series of straight, interdigitated fingers. FIG. 7 illustrates the electrode pattern of a lamp wherein the electrodes 22 and 24 are arranged as a series of "wavy," interdigitated fingers. FIGS. 8–9 illustrate alternative arrangements for the top electrode 24 that can be used with a circular lamp body 40. FIG. 8 illustrates the electrode of a lamp having electrodes 22 and 24 being arranged as two interdigitated spirals. FIG. 9 illustrates the electrode pattern of a lamp having a electrodes 22 and 24 being disposed as a series of concentric semi-circles. FIG. 10 illustrates the top electrode 24 being disposed on the interior surface of the top plate 16. FIG. 11 illustrates the bottom electrode 22 being disposed on the interior surface of bottom plate 14.

From the foregoing it will be appreciated that, although specific embodiments of the invention have been described herein for purposes of illustration, various modifications may be made without deviating from the spirit and scope of the invention. For example, while the preferred embodiment of the invention uses electrodes on the exterior surfaces of the plates, the use of electrodes on at least one of the interior surfaces of the plates for planar fluorescent lamps is known, and may be used without departing form the scope of the invention. Accordingly, the invention is not limited except as by the appended claims.

What is claimed is:

1. A gas-filled photoluminescent planar lamp containing a photoluminescent material to emit visible light in response to ultraviolet energy emitted from an ionized gas, the lamp comprising:

first and second opposing glass plates manufactured from a glass material that has a dielectric constant of about 5 or greater and a loss tangent of about 0.05% or less when at a temperature of 20° C.;

a plurality of sidewalls coupled to peripheral edges of the first and second plates to define a chamber that contains the gas and photoluminescent material; and first and second electrodes disposed along an exterior surface of at least one of the first and second plates to create an electric field when electrical power is applied thereto to create an electric field that interacts with the gas contained within the chamber.

2. The lamp of claim 1, further comprising a plurality of spacer beads distributed between the first and second plates and having predetermined dimensions to maintain the first and second plates at a predetermined distance from each other.

3. The lamp of claim 2 wherein the plurality of spacers are manufactured from a glass material that is transmissive to ultraviolet radiation.

4. The lamp of claim 1, further comprising a plurality of spacers positioned between the first and second plates to maintain the first and second plates at a distance of about 0.5 millimeters or less from each other.

5. The lamp of claim 1 wherein the sidewalls are sized to maintain the first and second plates at a distance of about 0.5 millimeters or less between the first and second plates.

6. The lamp of claim 1 wherein the first plate is less than around 1 millimeter thick.

7. The lamp of claim 1 wherein a distance from the exterior surface of the first plate to the exterior surface of the second plate is less than around 5.0 millimeters.

8. The lamp of claim 1 wherein the first and second electrodes are disposed along the exterior surface of only one of the first and second plates.

9. The lamp of claim 1 wherein the first electrode is disposed along the exterior surface of the first plate and the second electrode is disposed along the exterior surface of the second plate.

10. The lamp of claim 1 wherein the first plate is composed of an aluminosilicate glass.

11. The lamp of claim 1 wherein at least one of the first and second plates is manufactured from a glass material being substantially free of sodium.

12. The lamp of claim 1, wherein the photoluminescent material comprises a layer of fluorescent and reflective material applied to an inner surface of at least one of the first and second plates wherein the layer luminesces in response to ionization of the contained gas.

13. A gas-filled photoluminescent planar lamp containing a photoluminescent material to emit visible light in response to ultraviolet energy emitted from an ionized gas, the lamp comprising:

first and second opposing glass plates manufactured from a glass material having a volume resistivity of greater than $1\times10^{12}$ Ωcm;

a plurality of sidewalls coupled to peripheral edges of the first and second plates to define a chamber that contains the gas and photoluminescent material; and first and second electrodes disposed along an exterior surface of at least one of the first and second plates to create an electric field when electrical power is applied thereto to create an electric field that interacts with the gas contained within the chamber.

14. The lamp of claim 13, further comprising a plurality of spacers distributed between the first and second plates and having predetermined dimensions to maintain the first and second plates at a predetermined distance from each other.

15. The lamp of claim 13 wherein the first and second electrodes are disposed along the exterior surface of only one of the first and second plates.

16. The lamp of claim 13 wherein the first plate has a dielectric constant of greater than around 5.

17. The lamp of claim 13 wherein at least one of the first and second plates is manufactured from a glass material being substantially free of sodium.

18. A gas-filled photoluminescent planar lamp containing a photoluminescent material to emit visible light, the lamp comprising:

a chamber having a gas and photoluminescent material therein, the chamber being composed of a light transmissive front plate, a back plate and a plurality of sidewalls coupled to the peripheral edges of the front plate and the back plate to define the chamber;

a front electrode positioned adjacent the front plate;

a back electrode positioned adjacent the back plate;

the front and back plates being parallel to each other and flat, the first plate being composed of a glass material having a dielectric constant of about 5 or greater and a resistivity of about 1 $10^{12}$ Ωcm or greater when at a temperature of 20° C.;

a plurality of spacer beads positioned inside of the chamber, the spacer beads being composed of transparent glass material and having a diameter approximately equal to the distance between the front plate and the side plate in order to maintain the integrity of the chamber of the lamp to prevent implosion and to maintain the front plate and the back plate at a predetermined distance from each other.

19. The planar lamp according to claim 18 wherein the front electrode contains a plurality of grid members having a first pattern and the back electrode contains a plurality of grid members having a second pattern, different than the first pattern and having portions of the back electrode grid which are offset from electrically conductive portions of the front electrode grid.

20. The lamp according to claim 18 wherein the back electrode is composed of wider electrically conductive lines than the front electrode.

21. The lamp according to claim 19 wherein the back electrode has a larger composite surface area than the front electrode.

* * * * *